US010714854B2

(12) United States Patent
Peng et al.

(10) Patent No.: US 10,714,854 B2
(45) Date of Patent: Jul. 14, 2020

(54) CIRCULAR CONNECTOR

(71) Applicants: FUYU ELECTRONICAL TECHNOLOGY (HUAIAN) CO., LTD., Huai'an (CN); FOXCONN INTERCONNECT TECHNOLOGY LIMITED, Grand Cayman (KY)

(72) Inventors: Bin Peng, Kunshan (CN); Kuo-Chun Hsu, New Taipei (TW); Chang-Hsien Tung, New Taipei (TW); Zhi-Jian Chen, Kunshan (CN)

(73) Assignees: FUYU ELECTRONICAL TECHNOLOGY (HUAIAN) CO., Huai'an (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/258,548

(22) Filed: Jan. 26, 2019

(65) Prior Publication Data

US 2019/0237889 A1 Aug. 1, 2019

(30) Foreign Application Priority Data

Jan. 30, 2018 (CN) ..... 2018 2 0163951 U

(51) Int. Cl.
*H01R 13/11* (2006.01)
*H01R 13/42* (2006.01)
(Continued)

(52) U.S. Cl.
CPC ..... *H01R 13/11* (2013.01); *H01R 13/113* (2013.01); *H01R 13/187* (2013.01); *H01R 13/42* (2013.01);
(Continued)

(58) Field of Classification Search
CPC ..... H01R 13/11; H01R 13/15; H01R 13/187; H01R 13/40; H01R 13/42; H01R 13/502;
(Continued)

(56) References Cited

U.S. PATENT DOCUMENTS 5,102,353 A * 4/1992 Brunker ..... H01R 13/6471 439/607.08
5,304,069 A * 4/1994 Brunker ..... H01R 23/688 439/108
5,876,248 A * 3/1999 Brunker ..... H01R 13/6582 439/607.08
6,945,796 B2 * 9/2005 Bassler ..... H01R 12/724 439/101
7,762,857 B2 * 7/2010 Ngo ..... H01R 13/432 439/747
(Continued)

FOREIGN PATENT DOCUMENTS

CN 103107454 B 10/2015

*Primary Examiner* — Oscar C Jimenez
(74) *Attorney, Agent, or Firm* — Wei Te Chung; Ming Chieh Chang

(57) ABSTRACT

The electrical connector includes an insulative housing having a columnar section and an annular groove surrounding the columnar section. The column section includes a mating face and a plurality of power contact passageways and a plurality of signal contact passageways extending through the mating face wherein the signal contacts and the power contacts are commonly arranged with a cross configuration area to have the signal contacts located by opposite upper and lower sides of the power contacts. Both the power contacts and the signal contacts of the plug connector are of a blade type while both the power contacts and the signal contacts of the receptacle connector are of a clamp type wherein each signal contact has one clamping structure while each power contact has a pair of clamping structures side by side arranged with each other.

20 Claims, 17 Drawing Sheets

(51) Int. Cl.

| | |
|---|---|
| ***H01R 13/502*** | (2006.01) |
| ***H01R 13/187*** | (2006.01) |
| ***H01R 13/6581*** | (2011.01) |
| ***H01R 13/641*** | (2006.01) |
| ***H01R 13/642*** | (2006.01) |

(52) U.S. Cl.
CPC ..... *H01R 13/502* (2013.01); *H01R 13/641* (2013.01); *H01R 13/642* (2013.01); *H01R 13/6581* (2013.01)

(58) Field of Classification Search
CPC H01R 13/641; H01R 13/642; H01R 13/6471; H01R 13/6474; H01R 13/6581; H01R 13/652
See application file for complete search history.

(56) References Cited

U.S. PATENT DOCUMENTS

| | | | | |
|---|---|---|---|---|
| 7,794,288 | B2 * | 9/2010 | Shindo | H01R 13/533 439/347 |
| 9,728,902 | B2 * | 8/2017 | Hoher | H01R 9/038 |
| 2008/0297988 | A1 * | 12/2008 | Chau | H01R 13/426 361/741 |
| 2012/0242234 | A1 * | 9/2012 | Long | H01R 13/6456 315/165 |
| 2014/0227901 | A1 * | 8/2014 | Mosier | H01R 13/533 439/359 |
| 2015/0258905 | A1 * | 9/2015 | Fukushima | H01R 13/506 439/34 |
| 2017/0194738 | A1 * | 7/2017 | Poncini | H01R 4/023 |
| 2017/0244193 | A1 * | 8/2017 | Kondo | H01R 13/504 |

* cited by examiner

CIRCULAR CONNECTOR

BACKGROUND OF THE INVENTION

1. Field of the Invention

The present invention relates generally to an electrical connector, and more particularly to the circular connector for delivering power.

2. Description of Related Arts

U.S. Pat. No. 10,135,163 discloses an electrical power connector with the planar contact having two opposite spring arms for sandwiching a blade type contact of the complementary connector therebetween. Anyhow, some variations are required for variety use including signal transmission.

An electrical connector is desired with densely arranged large power contacts and small signal contacts therein in a robust manner.

SUMMARY OF THE INVENTION

An object of the present invention is to provide an electrical connector for providing both power delivery and signal delivery. The electrical connector includes an insulative housing having a columnar section and an annular groove surrounding the columnar section. The column section includes a mating face and a plurality of power contact passageways and a plurality of signal contact passageways extending through the mating face wherein the signal contacts and the power contacts are commonly arranged with a cross configuration area to have the signal contacts located by opposite upper and lower sides of the power contacts. Both the power contacts and the signal contacts of the plug connector are of a blade type while both the power contacts and the signal contacts of the receptacle connector are of a clamp type wherein each signal contact has one clamping structure while each power contact has a pair of clamping structures side by side arranged with each other.

In the receptacle connector, each signal contact has a joined single tail section while each power has a pair of tail sections corresponding to the upper clamping structure of the contacting section. In addition, the plug connector includes a pair of ribs to be received within the corresponding notches in the receptacle connector for alignment during mating.

DETAILED DESCRIPTION OF THE PREFERRED EMBODIMENT

Figure 1:
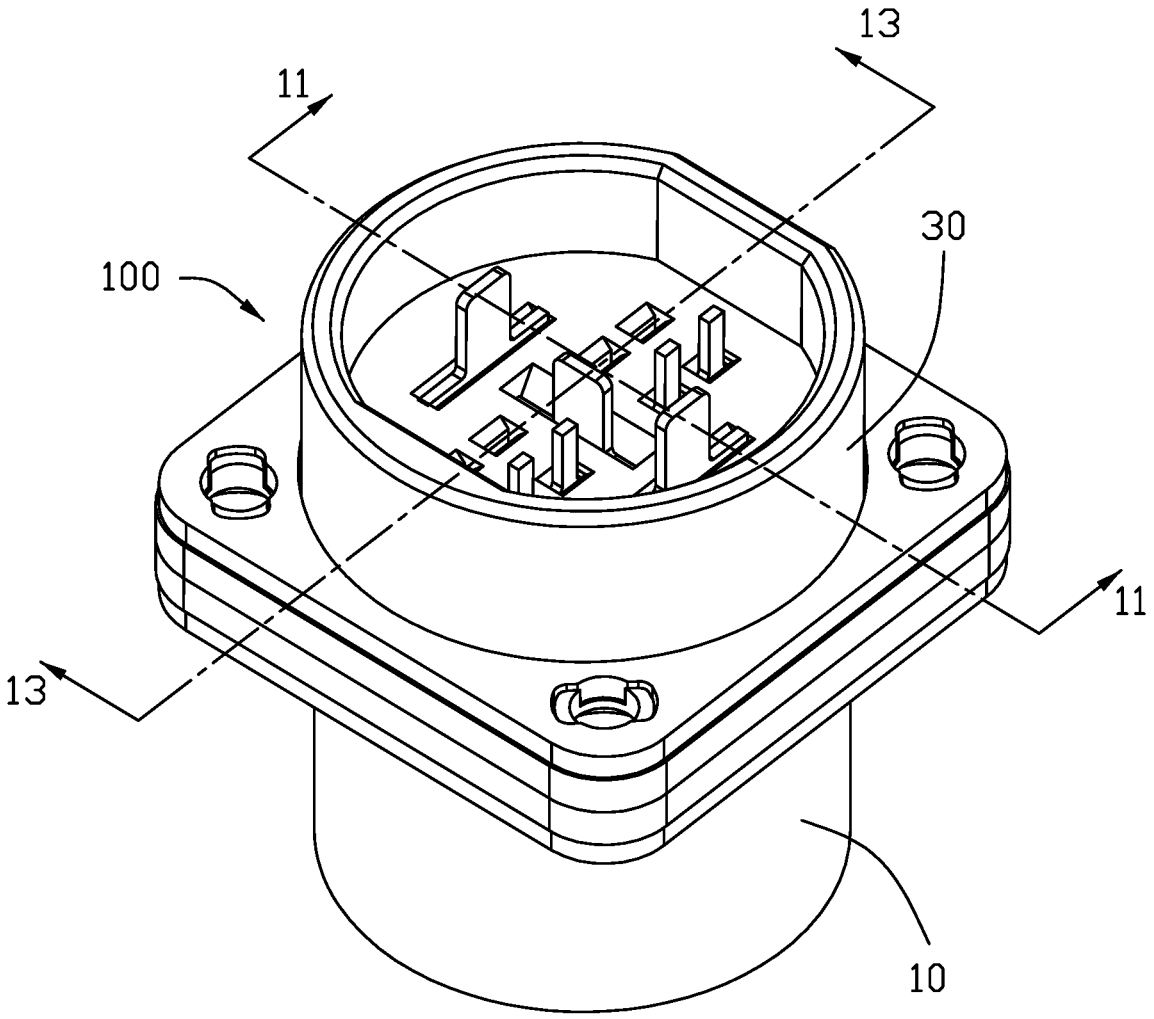
FIG. 1 is a perspective view of an electrical connector assembly of the receptacle connector and the plug connector mated with each other according to the present invention.
Figure 2:
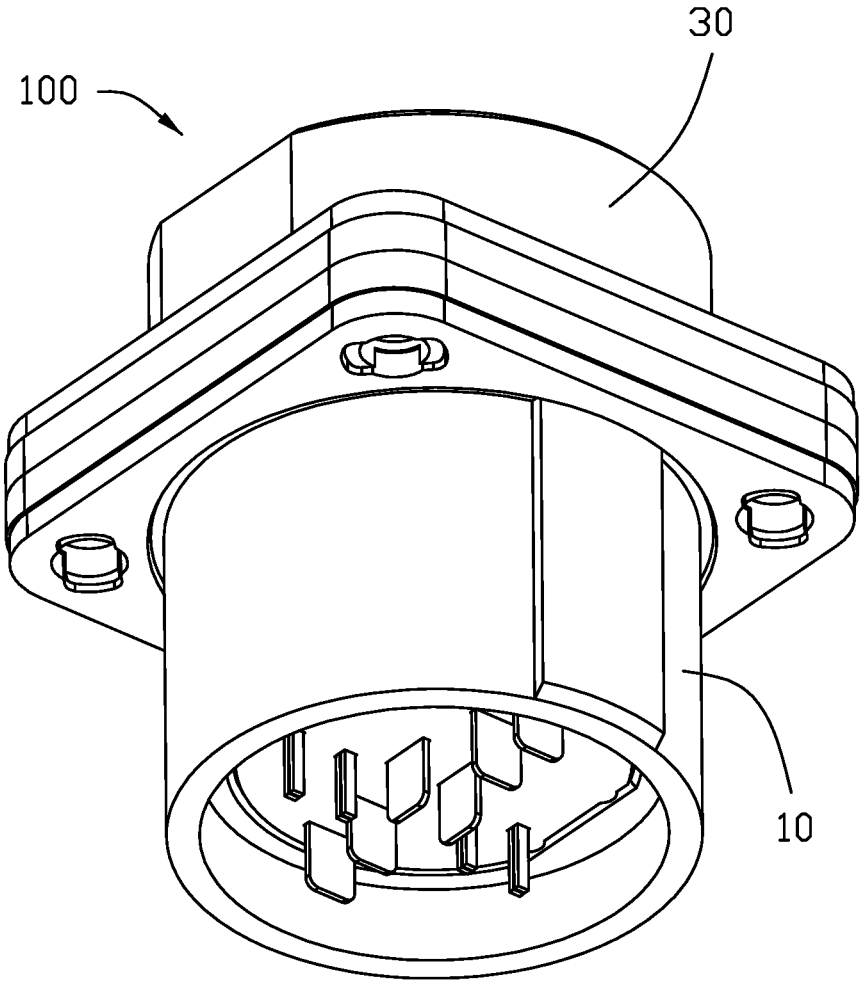
FIG. 2 is another perspective view of the electrical connector assembly of FIG. 1.
Figure 3:
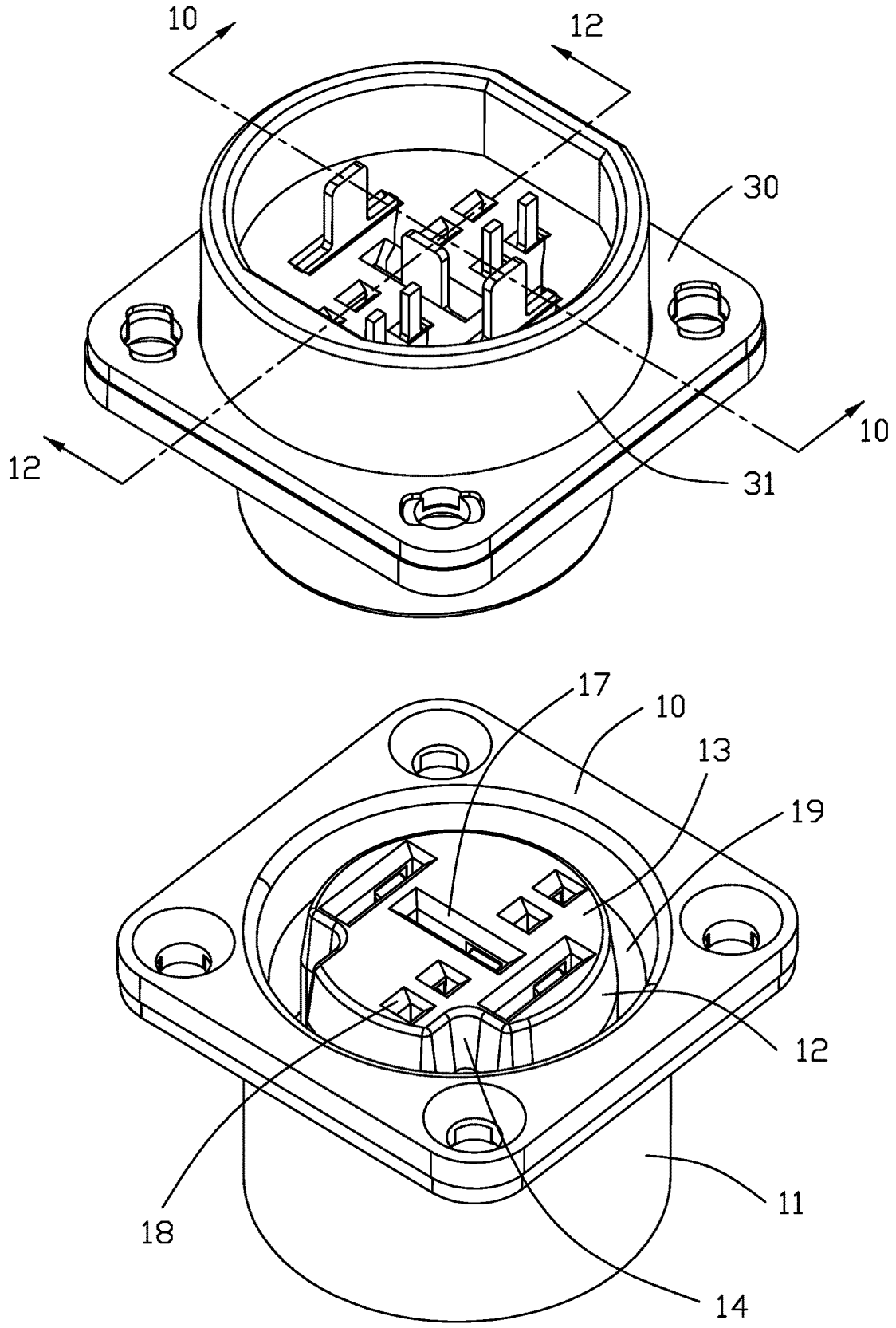
FIG. 3 is a perspective view of the electrical connector assembly of FIG. 1 wherein the plug connector is removed away from the receptacle connector.
Figure 4:
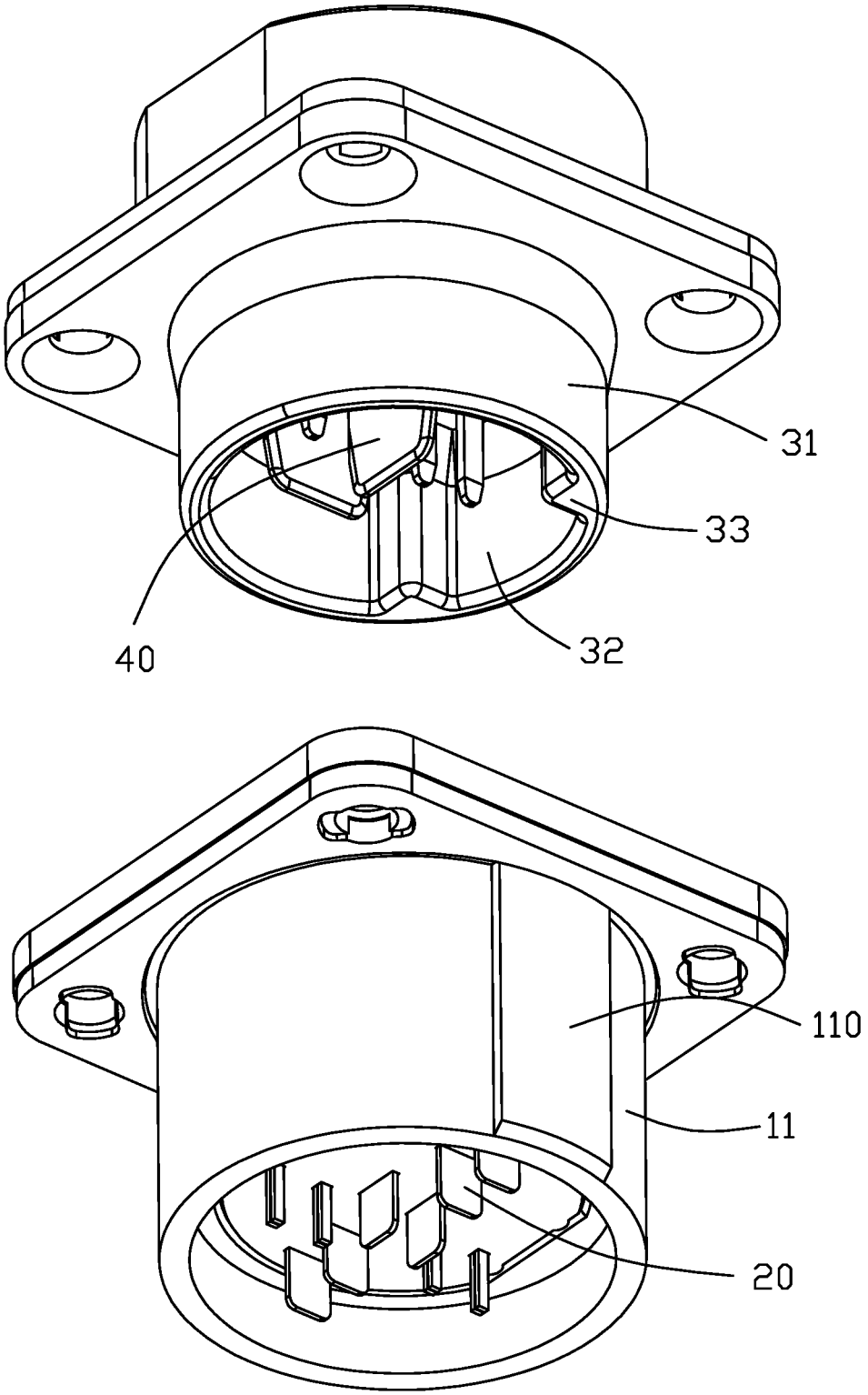
FIG. 4 is another perspective view of the electrical connector assembly of FIG. 3.
Figure 5:
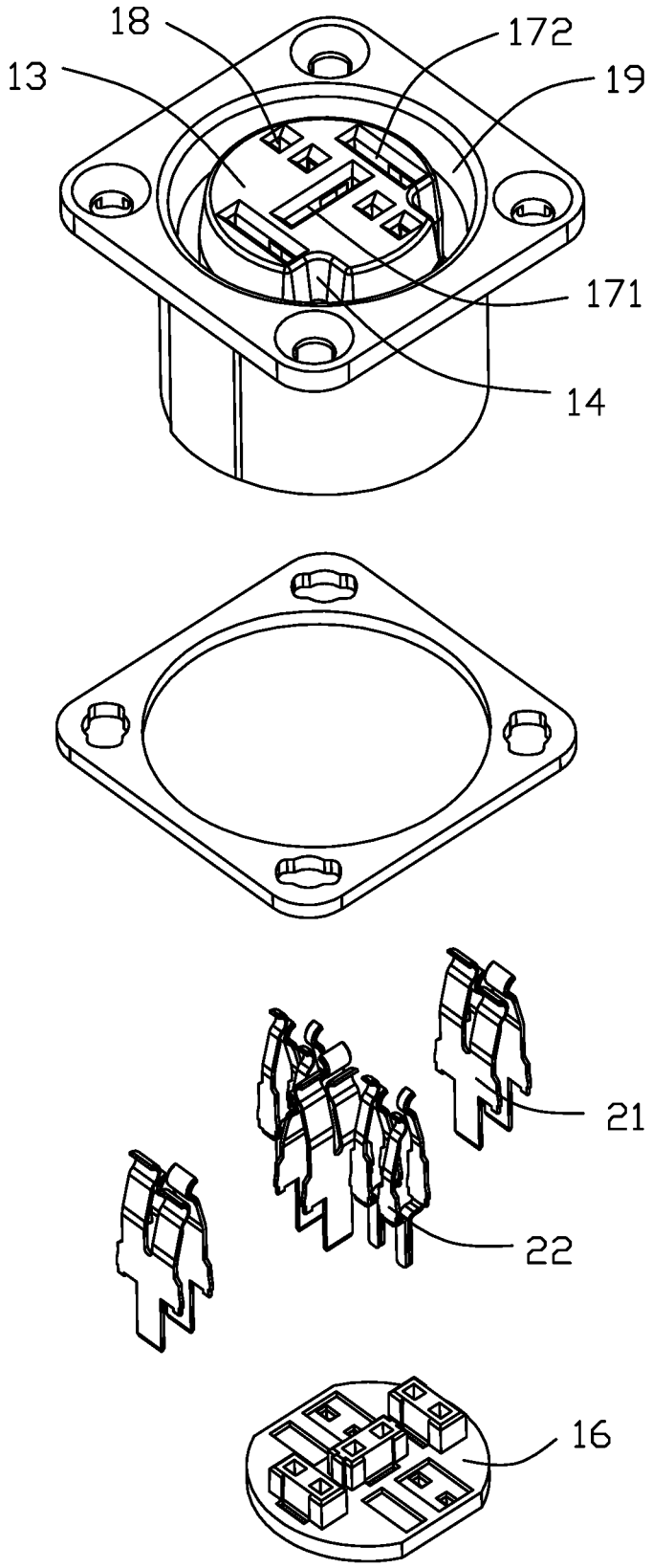
FIG. 5 is an exploded perspective view of the receptacle connector assembly of FIG. 1.
Figure 6:
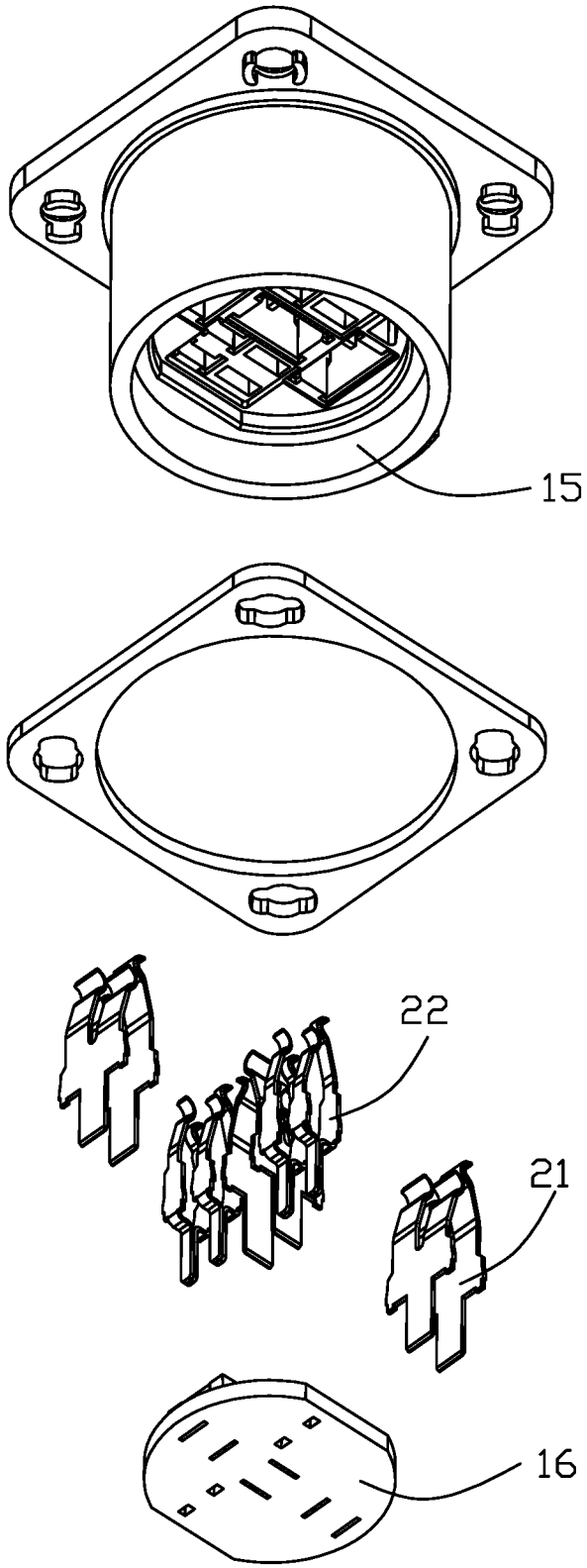
FIG. 6 is another perspective view of the receptacle connector assembly of FIG. 5.
Figure 7:
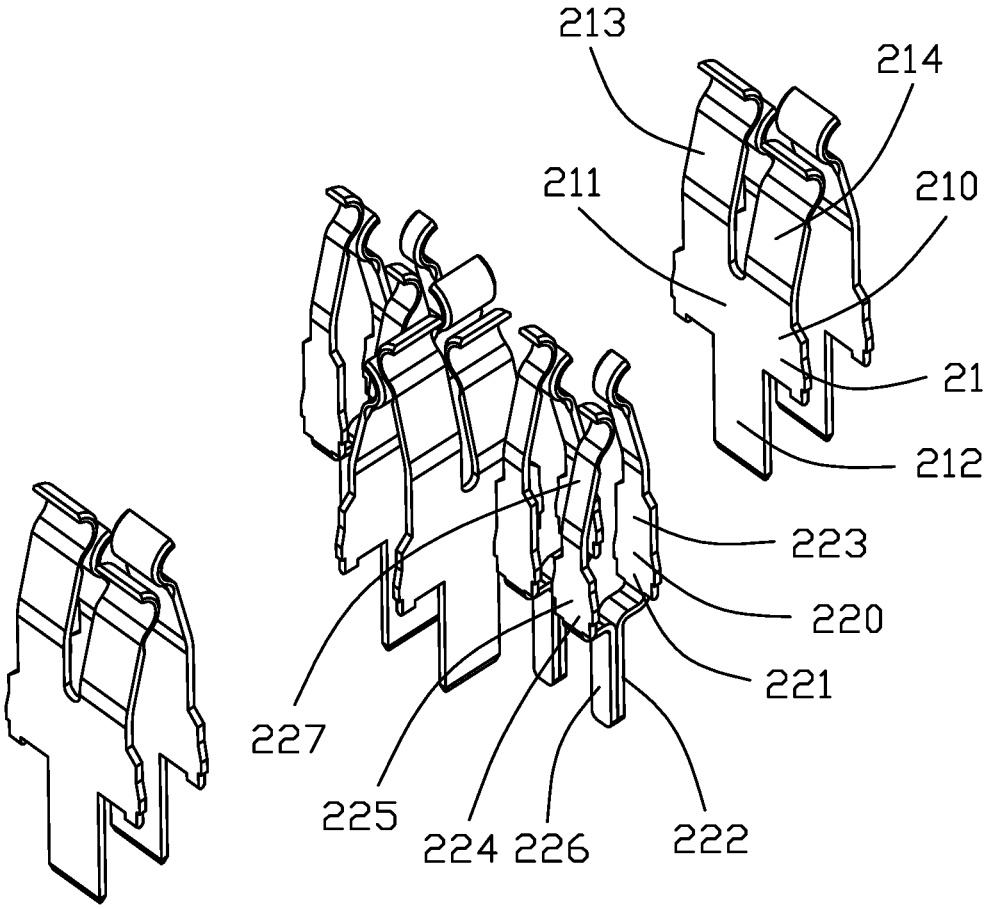
FIG. 7 is a perspective view of the receptacle contacts of the receptacle connector of FIG. 5.
Figure 8:
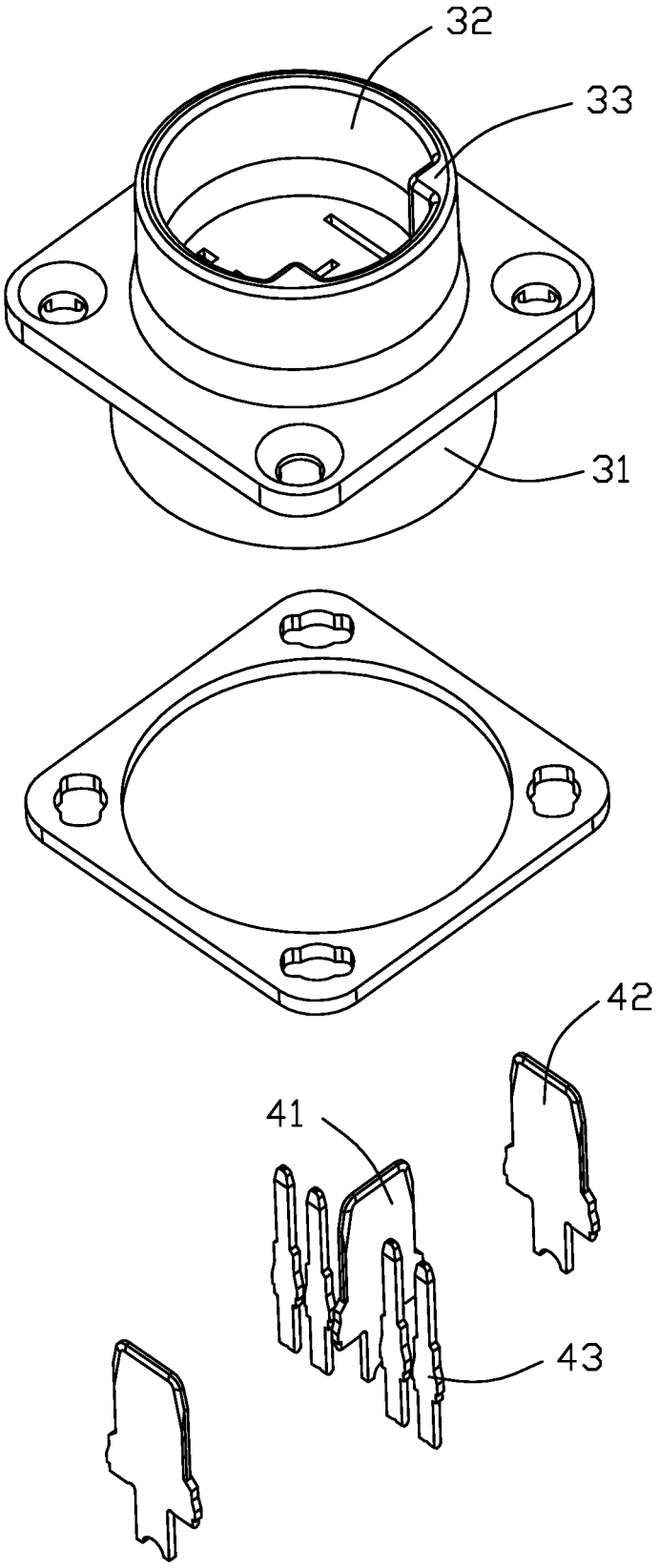
FIG. 8 is an exploded perspective view of the plug connector of FIG. 1.
Figure 9:
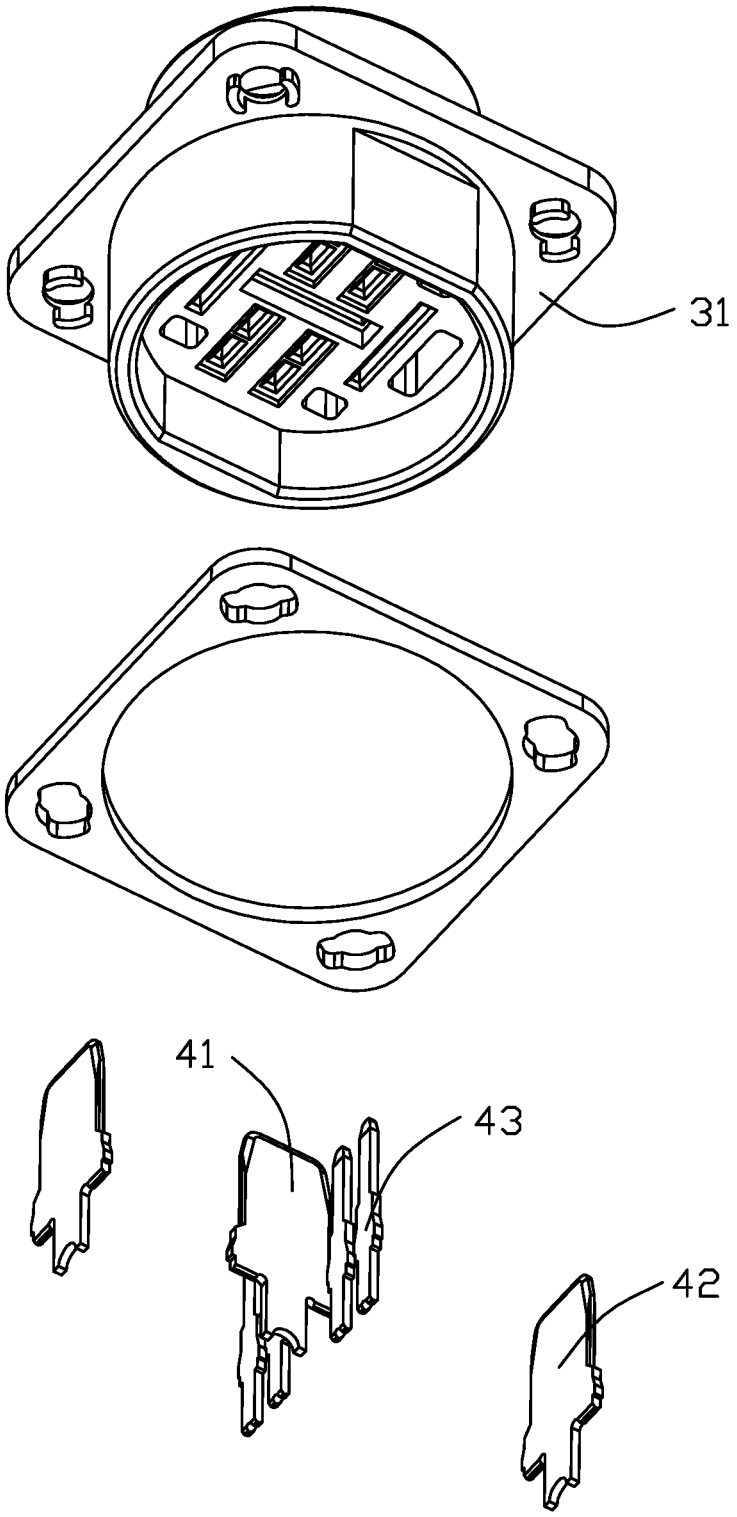
FIG. 9 is another perspective view of the plug connector assembly of FIG. 8.
Figure 10:
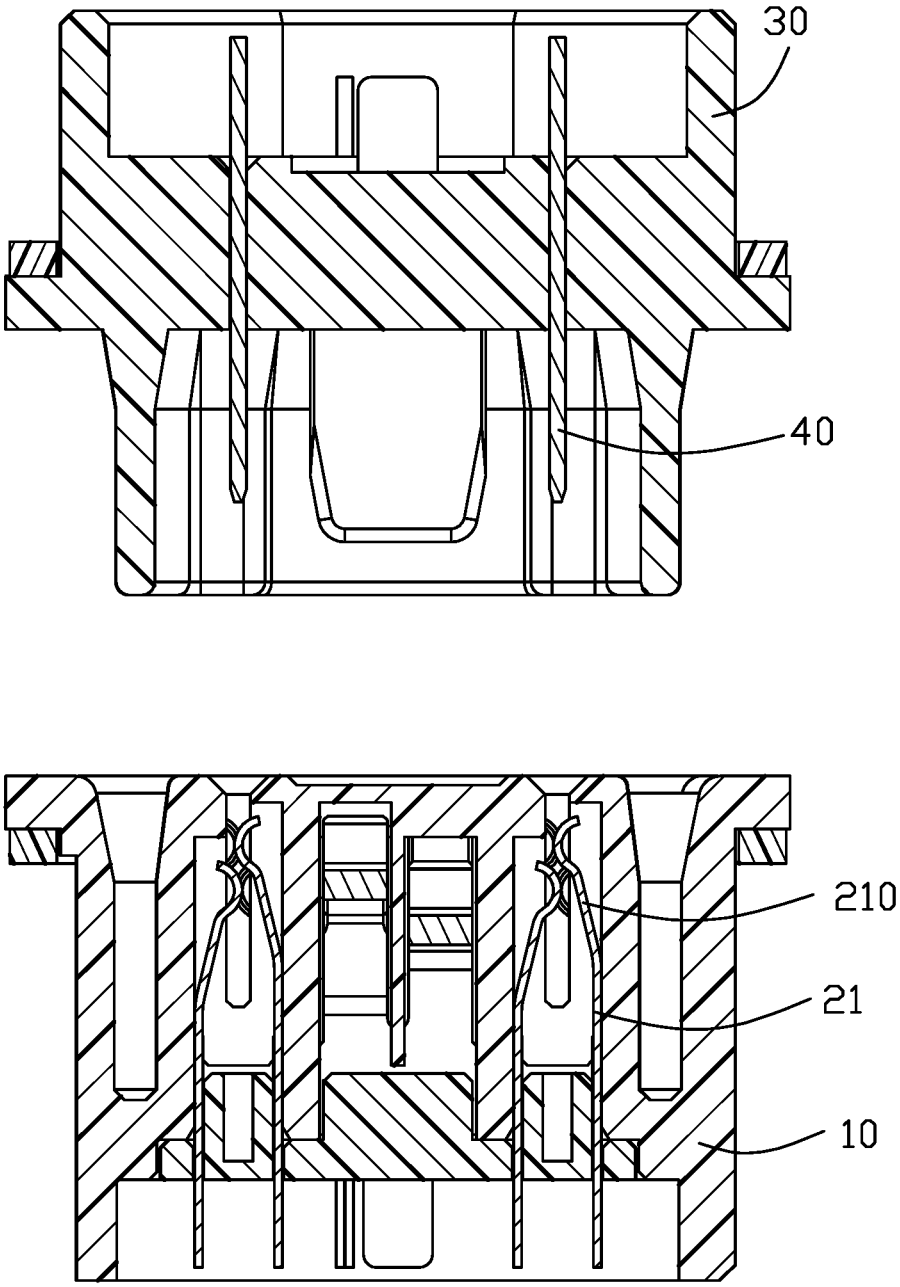
FIG. 10 is a cross-sectional view of the electrical connector assembly of FIG. 1 to show how the upper and lower power plug contacts of the plug connector are aligned and ready to be mated with the corresponding power contacts of the receptacle connector.
Figure 11:
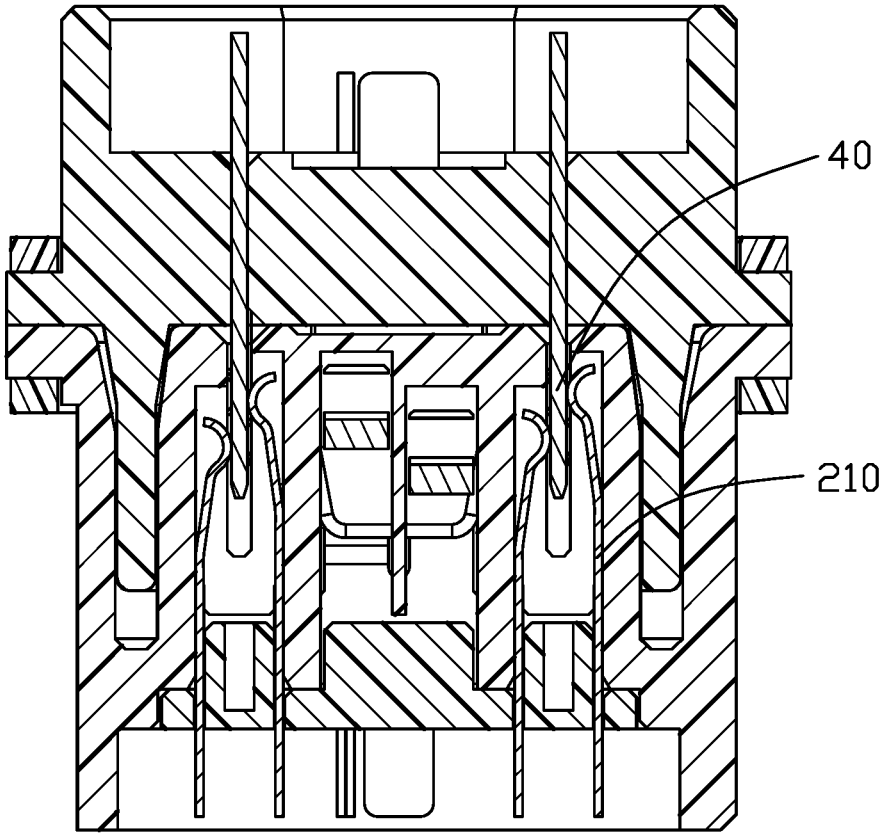
FIG. 11 is a cross-sectional view of the electrical connector assembly of FIG. 1 to show how the upper and lower power plug contacts of the plug connector mated with the corresponding power contacts of the receptacle connector.
Figure 12:
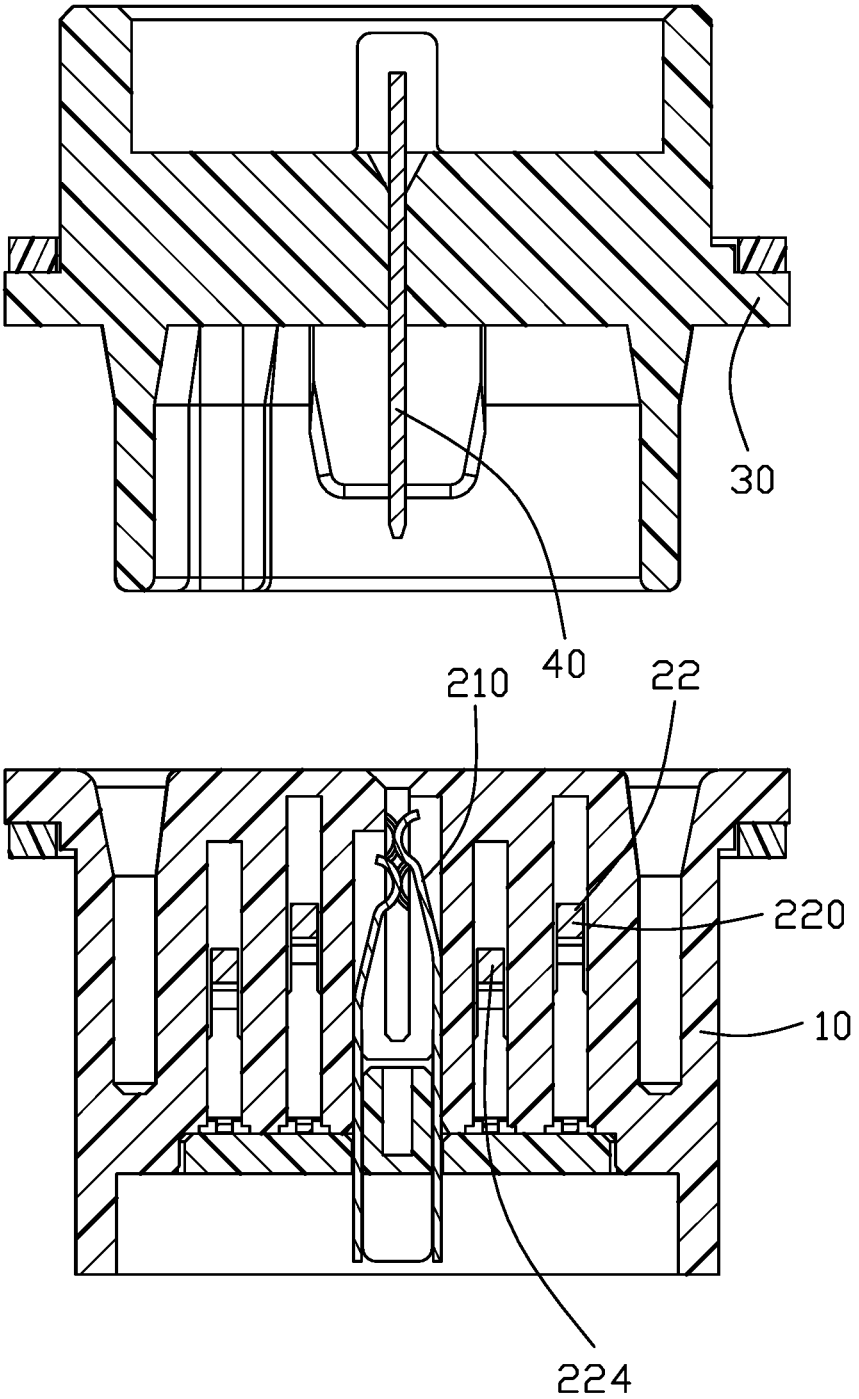
FIG. 12 is a cross-sectional view of the electrical connector assembly of FIG. 1 to show how the middle power plug contacts of the plug connector is aligned and ready to be mated with the corresponding power contact of the receptacle connector.
Figure 13:
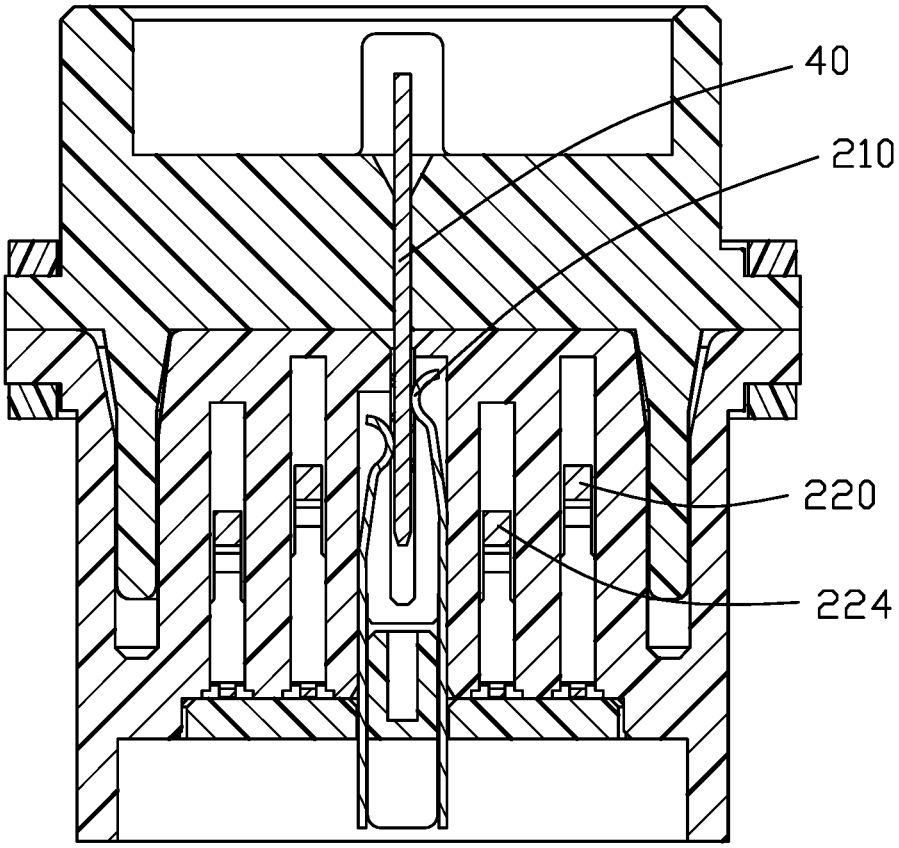
FIG. 13 is a cross-sectional view of the electrical connector assembly of FIG. 1 to show how the middle power plug contact of the plug connector mated with the corresponding power contact of the receptacle connector.
Figure 14:
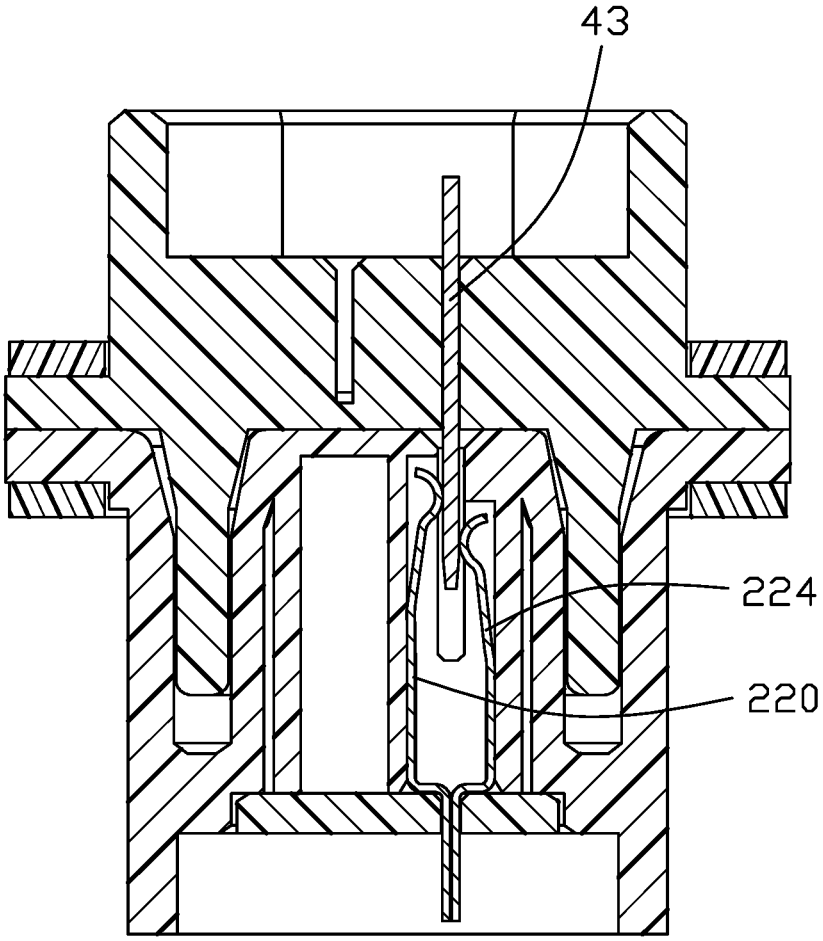
FIG. 14 is a cross-sectional view of the electrical connector assembly of FIG. 1 to show how the signal contact of the plug connector is mated with the corresponding power contact of the receptacle connector.
Figure 15:
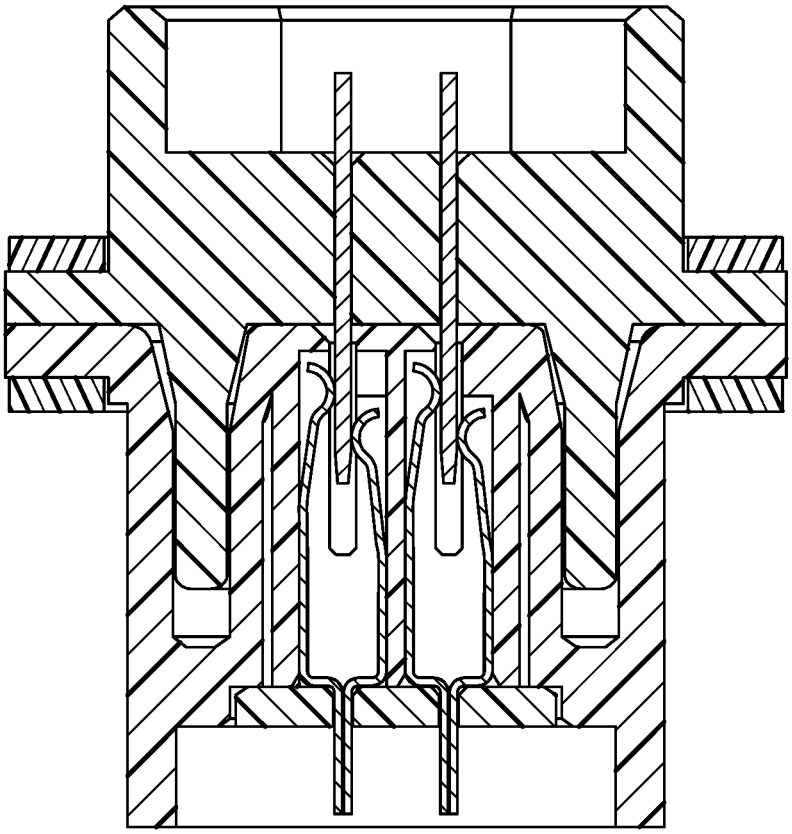
FIG. 15 is a cross-sectional view of the electrical connector assembly of FIG. 1 to show how the signal contact of the plug connector is mated with the corresponding power contact of the receptacle connector according to the second embodiment of the invention wherein there are two rows of the signal contacts instead of one row.

Referring to FIG. 1-14, an electrical connector assembly 100 includes a receptacle connector 10 and a plug connector 30 mated with each other. The receptacle connector 10 include an insulative receptacle housing 11 and a plurality of receptacle contacts 20 retained in the housing 11. The receptacle housing 11 includes a columnar section 12 and an annular groove 19 surrounding the columnar section 12. The columnar section 12 forms a mating face 13. Three power contact passageways 17 and four signal contact passageways 18 are formed in the columnar section 12. The three power contact passageways 17 include a center power contact passageway 171 and two side power contact passageways 172. The signal contact passageways 18 arranged in one row are evenly arranged by opposite upper and lower sides of the center power contact passageway 171. In an alternate embodiment as shown in FIG. 15, two rows of signal contact passageways may be arranged instead for enhancing signal transmission, if necessary. Even though the three power contact passageways 17 are arranged in the vertical direction, the orientation of the center power contact passageway 171 is perpendicular to those of the side power contact passageways 172. A pair of alignment notches 141 are formed in two opposite upper corners. A receiving cavity 15 is formed in a back side of the power housing 12 opposite to the mating face 13. A cover 16 is assembled in the receiving cavity 15. A glue plate (not shown) may be optionally applied upon the rear face of the cover 16 for waterproof. A protrusion 110 is formed on the receptacle housing 11 for complying with an external part for foolproof.

The contacts 20 includes three power contacts 21 respectively received within the corresponding power contact passageways 17, and four signal contacts 22 respectively received within the corresponding signal contact passageways 18. Each power contact 21 includes a pair of opposite spring plates 210 spaced from each other. Each spring plate 210 includes a main body 211, a first spring arm 213 and a second spring arm 214 respectively extending from an upper edge of the main body 211 wherein the first spring arm 213 is longer than the second spring arm 214 with a contacting point closer to the mating face 13 than the second arm 214. Each power contact 21 has two pairs contacting points accordingly wherein in each pair the contacting points are complementarily arranged with each other rather than symmetrically. Each signal contact 22 includes a pair of opposite spring plates 220, 224. The spring plate 220 includes a main body 221, a tail section 222 extending rearwardly from the main body 221, and a contacting section 223 extending forwardly from the main body 221. Similarly, the spring plate 224 includes a main body 225, a tail section 226 extending rearwardly from the main body 225, and a contacting section 227 extending forwardly from the main body 225. The contacting section 223 is closer to the mating face 13 than the contacting section 227 in a complementary manner. Notably, the orientation of the center power contact 21 is different from those of all other contacts 20 including two side power contacts 21 and all signal contacts 22.

The plug connector 30 includes a plug housing 31 and a plurality of plug contacts 40 retained therein. The plug housing 31 forms a circular/cylindrical mating cavity 32 with a rear face (not labeled) behind the mating cavity 32. The plug contacts 40 includes a blade type center power contact 41 and two blade type side power contacts 42 by two opposite lateral sides of the center power contact 41, and four blade type signal contacts 43 evenly located by opposite upper and lower sides of the center power contacts 41 wherein the orientation of the center power contact 41 is different from those of both the side power contacts 42 and the signal contacts 43. A pair of alignment ribs 33 are formed in the mating cavity 32 for reception within the corresponding alignment notches 14 during mating.

During mating, the plug signal contact 43 is sandwiched between the paired spring plates 220 and 224 of each receptacle signal contact 22 so as to form two contacting points at different positions along the mating/front-to-back direction. Similarly and advancingly, the plug power contact 41/42 is sandwiched between the paired spring plates 210 of the receptacle power contact 21 so as to form four contacting points at different positions along both the mating/front-to-back direction and the lateral direction with regard to each spring plates 210.

Notably, the spirit of the invention is to efficiently arrange both the smaller signal contacts and the larger power contacts within a limited/confined space wherein the signal contacts may be allowed to be doubled, compared with the first embodiment, as shown in FIG. 15, if desired/required, i.e., adding another row of signal contacts beside the original row of signal contacts so as to have both rows of the signal contacts 22/43 are equally/evenly divided by the center power contact 21/41 into opposite upper side group and lower side group equally. This is the reason why the cross configuration of the power contacts and the signal contacts is arranged within a circular/cylindrical space for consideration of efficient space use and force-balancing with regard to the center of the mating cavity 32 wherein the orientation of the center power contact is perpendicular to those of all other contacts.

Figure 16:
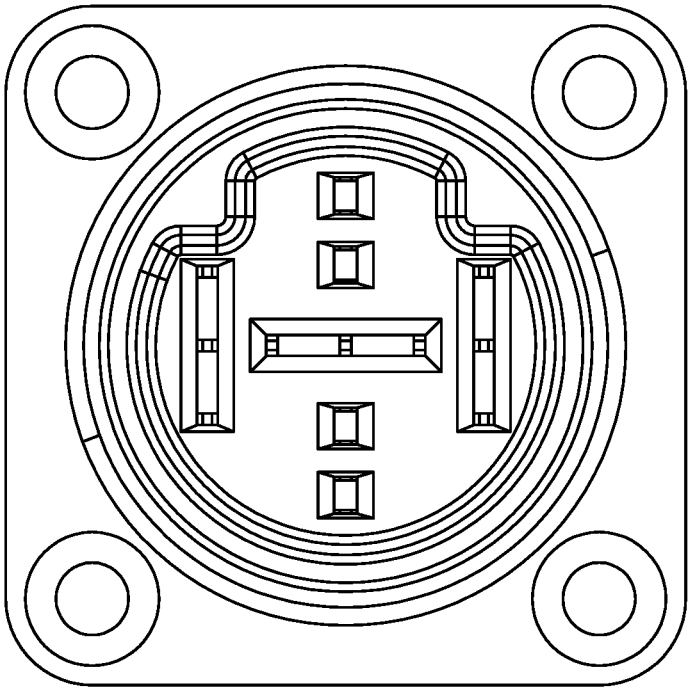
FIG. 16 is an elevation view showing the cross configuration of the signal contacts and the power contacts according to a third embodiment of the invention.
Figure 17:
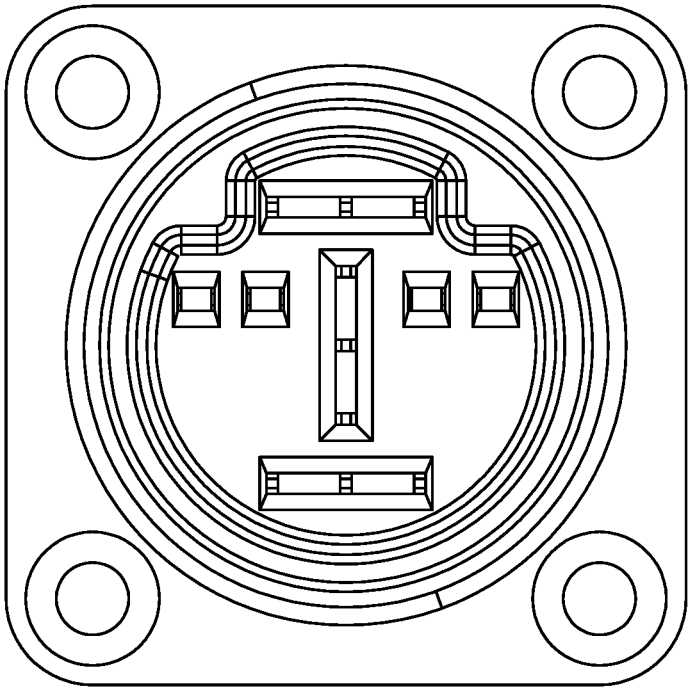
FIG. 17 is an elevation view showing the cross configuration of the signal contacts and the power contacts according to a fourth embodiment of the invention

Therefore, in alternate embodiments as shown in FIG. 16, the single row of signal contacts may be located along the vertical center line of the connector, and in FIG. 17, the single row of signal contacts are divided into two groups by two lateral sides with regard to the center power contact in the transverse direction. In brief, the cross configuration of the intermixed signal contacts and power contacts cooperating the differently oriented center power contact from those of all remaining contacts may provide efficient use in a circular space wherein the power contacts are arranged in one row in the first/vertical direction to constitute the vertical bar of the cross configuration while the signal contacts are arranged in another row in the second/horizontal direction to constitute the horizontal bar of the cross configuration, the vertical direction and the horizontal direction being interchangeable with each other.

What is claimed is:

1. An electrical connector for mating with a complementary connector along a front-to-back direction, comprising:

an insulative housing;

a plurality of contacts retained in the housing with a cross configuration viewed in the front-to-back direction, and including:

a plurality of power contacts arranged in one row in a vertical direction perpendicular to the front-to-back direction to constitute a vertical bar of the cross configuration;

a plurality of signal contacts arranged in another row in a horizontal direction perpendicular to both said front-to-back direction and the vertical direction to constitute a horizontal bar of said cross configuration perpendicular to said vertical bar; wherein said contacts include one at a center of the housing, and the contact at the center extends wholly along the vertical direction while all remaining respective contacts wholly extend along the horizontal direction.

2. The electrical connector as claimed in claim 1, wherein the power contacts are dimensionally larger than the signal contacts, and the center contact is the power contact.

3. The electrical connector as claimed in claim 1, wherein each power contact has four contacting points while each signal contact has only two contacting points.

4. The electrical connector as claimed in claim 3, wherein the electrical connector is a receptacle connector, and each signal contact has a pair of opposite spring plates by two sides of a mating signal contact of the complementary connector during mating while corresponding tail sections of said opposite spring plates are joined together.

5. The electrical connector as claimed in claim 4, wherein each power contact has a pair of opposite spring plates located by two sides of a mating power contact of the complementary connector and corresponding tail sections of said spring plates of the power contact are spaced from each other.

6. The electrical connector as claimed in claim 5, wherein each spring plate of the power contact forms a pair of spring arms laterally spaced from each other with different lengths thereof.

7. The electrical connector as claimed in claim 6, wherein in each power contact, the pair of spring arms of one spring plate and those of the other spring plates are arranged complementary with each other in the front-to-back direction.

8. The electrical connector as claimed in claim 3, wherein the electrical connector is a plug connector, and each of said signal contacts and said power contacts are of a blade type.

9. The electrical connector as claimed in claim 1, further including a pair of alignment devices on an upper portion of the housing.

10. The electrical connector as claimed in claim 9, wherein said housing defines a circular configuration in which the cross configuration are symmetrically disposed therein.

11. The electrical connector as claimed in claim 9, wherein there are three power contacts and four signal contacts by two sides of the power contacts.

12. An electrical connector assembly comprising:

a receptacle connector including an insulative receptacle housing with a plurality of receptacle contacts retained therein with a cross configuration viewed in a front-to-back direction, said receptacle contacts including a plurality of receptacle power contacts arranged in one row along a first direction perpendicular to the front-to-back direction to form a first bar of said cross configuration, and a plurality of receptacle signal contacts arranged in another row along a second direction perpendicular to both the front-to-back direction and the first direction to form a second bar of said cross configuration perpendicular to said first bar; and a plug connector including an insulative plug housing with a plurality of plug contacts retained therein with another cross configuration viewed in the front-to-back direction, said plug contacts including a plurality of plug power contacts arranged in one row along the first direction to form another first bar of said another cross configuration, and a plurality of plug signal contacts arranged in another row along the second direction to form another second bar of said another cross configuration perpendicular to said another first bar; wherein during mating, the plug power contacts are mated with the corresponding receptacle power contacts, respectively, and the plug signal contacts are mated with the corresponding receptacle signal contacts, respectively; wherein each of said plug power contacts and said plug signal contacts is of a blade type while each of said receptacle power contacts and said receptacle signal contacts is of a dual spring plates; wherein each receptacle signal contact has a joined single tail section while each receptacle power contact has a pair of spaced tail sections.

13. The electrical connector assembly as claimed in claim 12, wherein both the receptacle housing and the plug housing are of a circular configuration cross-section.

14. The electrical connector assembly as claimed in claim 13, wherein a pair of alignment devices are formed on an upper portion of each of the plug housing and the receptacle housing.

15. The electrical connector assembly as claimed in claim 12, wherein each receptacle power contact constitutes four contacting points while each receptacle signal contact constitutes two contacting points.

16. The electrical connector assembly as claimed in claim 12, wherein a middle one of the receptacle power contacts extends in the first direction while all other receptacle power contacts extend respectively in the second direction.

17. The electrical connector assembly as claimed in claim 16, wherein all receptacle signal contacts extend respectively in the second direction.

18. An electrical connector for mating with a complementary connector along a front-to-back direction, comprising:

an insulative receptacle housing;

a plurality of contacts retained in the housing with a cross configuration viewed in the front-to-back direction, and including:

a plurality of power contacts arranged in one row in a vertical direction perpendicular to the front-to-back direction to constitute a vertical bar of the cross configuration;

a plurality of signal contacts arranged in another row in a horizontal direction perpendicular to both said front-to-back direction and the vertical direction to constitute a horizontal bar of said cross configuration perpendicular to said vertical bar; wherein each power contact has four contacting points while each signal contact has only two contacting points.

19. An electrical receptacle connector for mating with a complementary connector along a front-to-back direction, comprising:

an insulative receptacle housing;

a plurality of contacts retained in the housing with a cross configuration viewed in the front-to-back direction, and including:

a plurality of power contacts arranged in one row in a vertical direction perpendicular to the front-to-back direction to constitute a vertical bar of the cross configuration;

a plurality of signal contacts arranged in another row in a horizontal direction perpendicular to both said front-to-back direction and the vertical direction to constitute a horizontal bar of said cross configuration perpendicular to said vertical bar; wherein each signal contact has a pair of opposite spring plates by two sides of a mating signal contact of the complementary connector during mating while corresponding tail sections of said opposite spring plates are joined together; wherein the pair of opposite spring plates respectively having a long spring arm and a short spring arm with different contacting points thereof, and two neighboring signal contacts are reversely arranged with each other so as to have the long spring arm of one signal contact is aligned with the short spring arm of the other signal contact in the horizontal direction.

20. The electrical receptacle connector as claimed in claim 19, wherein one power of the power contact is located at an intersection of said two rows.

* * * * *